US009204778B2

(12) United States Patent
Jerg et al.

(10) Patent No.: US 9,204,778 B2
(45) Date of Patent: Dec. 8, 2015

(54) DISHWASHER WITH A MANUALLY ADAPTABLE WASH PROGRAM

(75) Inventors: Helmut Jerg, Giengen (DE); Andreas Reiter, Finningen (DE); Michael Georg Rosenbauer, Reimlingen (DE)

(73) Assignee: BSH Hausgeraete GmbH, Munich (DE)

( * ) Notice: Subject to any disclaimer, the term of this patent is extended or adjusted under 35 U.S.C. 154(b) by 301 days.

(21) Appl. No.: 13/195,879

(22) Filed: Aug. 2, 2011

(65) Prior Publication Data

US 2012/0042908 A1 Feb. 23, 2012

(30) Foreign Application Priority Data

Aug. 20, 2010 (DE) ..... 10 2010 039 611

(51) Int. Cl.
*A47L 15/00* (2006.01)
*A47L 15/44* (2006.01)
*A47L 15/46* (2006.01)

(52) U.S. Cl.
CPC ..... *A47L 15/0021* (2013.01); *A47L 15/0005* (2013.01); *A47L 15/0007* (2013.01); *A47L 15/0013* (2013.01); *A47L 15/0018* (2013.01); *A47L 15/0049* (2013.01); *A47L 2301/00* (2013.01); *A47L 2301/04* (2013.01); *A47L 2301/08* (2013.01); *A47L 2501/01* (2013.01); *A47L 2501/05* (2013.01); *A47L 2501/07* (2013.01); *A47L 2501/30* (2013.01)

(58) Field of Classification Search
CPC ..... A47L 15/0005; A47L 15/0007; A47L 15/0013; A47L 15/0018; A47L 15/0021; A47L 2301/00; A47L 2301/04; A47L 2301/08; A47L 2501/30; A47L 15/0049; A47L 2501/01; A47L 2501/05; A47L 2501/07
USPC ..... 134/56 D
See application file for complete search history.

(56) References Cited

U.S. PATENT DOCUMENTS

| | | | | |
|---|---|---|---|---|
| 3,798,465 | A * | 3/1974 | Guth | 307/141 |
| 5,331,986 | A * | 7/1994 | Lim et al. | 134/88 |
| 6,007,640 | A * | 12/1999 | Neff et al. | 134/18 |
| 2005/0161064 | A1* | 7/2005 | Clouser | 134/57 D |
| 2007/0246069 | A1* | 10/2007 | Elick et al. | 134/18 |
| 2007/0251544 | A1* | 11/2007 | Elick et al. | 134/10 |
| 2009/0056756 | A1* | 3/2009 | Son | 134/18 |
| 2009/0078289 | A1* | 3/2009 | Son et al. | 134/18 |
| 2009/0139544 | A1* | 6/2009 | Ahn et al. | 134/18 |
| 2009/0217948 | A1* | 9/2009 | Kang | 134/18 |
| 2010/0154830 | A1* | 6/2010 | Lau et al. | 134/25.2 |
| 2011/0209729 | A1* | 9/2011 | Beaudet et al. | 134/18 |

* cited by examiner

*Primary Examiner* — Joseph L Perrin
*Assistant Examiner* — Levon J Shahinian
(74) *Attorney, Agent, or Firm* — James E. Howard; Andre Pallapies

(57) ABSTRACT

A dishwasher, especially a household dishwasher, includes a control device, in which at least one wash program for carrying out a wash cycle comprising a number of part wash cycles for cleaning and/or drying items to be washed is stored, and an operating device for entering operating commands for the control device. At least one operating command for carrying out one or more adaptation measures on at least one of the wash programs can be input at the operating device to improve avoidance of spots on the items to be washed and/or the drying result on the washed items, when the wash cycle based on the adapted wash program is carried out.

41 Claims, 4 Drawing Sheets

DISHWASHER WITH A MANUALLY ADAPTABLE WASH PROGRAM

BACKGROUND OF THE INVENTION

The present invention relates to a dishwasher, especially to a household dishwasher, with a control device, for which at least one wash program is stored for executing, especially controlling and/or regulating, a wash cycle comprising a number of part wash cycles for cleaning and/or for drying washed items, and with an operating device for entering operating commands for the control device.

Commercially-available dishwashers are embodied to automatically clean dishes with washing fluid. In such cases users of dishwashers impose many, in some cases conflicting, demands on a dishwasher. Such demands typically include highly effective cleaning, highly effective drying, low water and energy consumption, a short wash cycle but also the avoidance of spots on the cleaned dishes.

BRIEF SUMMARY OF THE INVENTION

It is an object of the present invention to provide a dishwasher, especially a household dishwasher, which better meets the demands of the users.

The object is achieved for a dishwasher of the type stated above by enabling at least one operating command to be entered at the operating device for executing one or more adaptation measures on at least one of the wash programs, by means of which the avoidance of spots on the washed items and/or the drying results on the washed items are improved during the execution of the wash cycle based on the adapted wash program.

The inventive dishwasher features a control device preferably for automatic carrying out, especially controlling or regulating, operational sequences of the dishwasher. To this end the control device can be embodied as a so-called sequence control, especially as an electronic sequence control. In an advantageous manner, in addition to or independently of control, it can also naturally be embodied for regulating and/or other checking or influencing of operational sequences of the dishwasher. The control device can, within the context of the invention, expressed in more general terms also particularly form a checking device, with which operational sequences, especially wash programs, are able to be monitored and/or influenced.

Stored in the control device is at least one washing program for executing or controlling a washing process, also referred to as a wash cycle, for washing items, especially for washing dishes. Advantageously in such cases a number of wash programs are provided, of which one can be selected and started by the user in each case. This makes it possible to adapt the sequence of a wash cycle, in particular to the amount of load, to the type of load and/or to the degree of soiling of the items to be washed. For example an energy-saving wash program can be provided in addition to the normal program which is optimized for a lower energy and/or water consumption for example, taking into account a reduced cleaning and/or drying effect. As a further example an intensive wash program can additionally be provided which has a higher cleaning and/or drying effect than the normal program, taking into account a higher energy and/or water consumption.

The respective stored wash program can preferably be embodied such that the respective wash cycle controlled by the wash program comprises a number of part wash cycles, especially at least one pre-wash cycle for pre-cleaning items to be washed, at least one cleaning cycle following on from it for basic cleaning of items to be washed, at least one intermediate rinse cycle following on from it for removing soiled washing fluid from the items to be washed, at least one final rinse cycle for avoiding spots on the items to be washed and/or for preparation for a following drying step or drying cycle and/or at least one final drying cycle for drying the items to be washed, in the order listed here. Pre-wash cycle, cleaning cycle, intermediate rinse cycle and final rinse cycle are referred to as water-conducting part wash cycles, since during their execution the items to be washed placed in the washing compartment are treated with washing fluid in each case. During the drying cycle there is generally no provision for using washing fluid.

The treatment of the items to be washed with washing fluid can be undertaken in this case in an essentially closed washing compartment, especially a washing container of the dishwasher. In such cases an inlet valve is assigned to the washing compartment which makes it possible to let washing fluid into the washing compartment. Furthermore the washing compartment is assigned a circulating pump for circulating the washing fluid with which the washing compartment is filled, which makes it possible to take the washing fluid present in the washing compartment from a collection device for washing fluid for example and to apply it to the items to be washed via a spray system assigned to the washing compartment.

A washing fluid here is especially to be understood as a liquid which is intended to be applied to the items to be washed, in order to clean said items and/or treat them in another way. Thus the washing fluid can typically also be used for heating up the items to be washed, which is possible for example during a final rinse step, in order to prepare for the subsequent drying cycle in which drying is at least partly based on the fact that the washing fluid adhering to the items to be washed evaporates because of the heat stored in the washing fluid, which is referred to as self drying. As an alternative or in addition, the washing fluid can be dried during the drying cycle by means of an air flow which is as hot and dry as possible, which is created with a sorption drying facility for example.

Furthermore an operating device is provided which is connected to the control device such that a user of the dishwasher can enter operating commands at the control device. An operating command in this case is to be understood as information which acts on the function of the control device in a planned manner. In such cases for example an operating command can be provided for manual selection of a wash program and an operating command can also be provided for starting a selected wash program.

In the inventive dishwasher an improvement in the avoidance of spots on cleaned items and/or of the drying results on items to be washed is possible which leads to a particular shine effect especially when these involve dishes, preferably glassware or metal cutlery or pots.

The improvement in this case is achieved via at least one adaptation measure to at least one of the wash programs. In such cases the least one adaptation measure is able to be carried out manually via an operating command able to be entered at the operating device for executing adaptation measures.

This enables the user, based on his individual requirements, to decide for each wash cycle whether he wishes to achieve the particular shine effect on the cleaned items or not. With the inventive dishwasher, for each wash cycle the user can weigh up from his individual standpoint whether the advantage of the particular shine effect on the items to be washed outweighs the possible disadvantages, such as a lengthening of the duration of the wash cycle and/or an increase in the water and/or energy consumption of the wash cycle for example.

The flexible use of the dishwasher thus achieved means the demands of users are better met.

Over and above this, with the inventive dishwasher, an improved shine effect can be achieved which was not, and is not possible with conventional dishwashers. The reason for this lies in the fact that, in a dishwasher in which measures for achieving a shine effect are already preset by the manufacturer of the dishwasher ex-works and would be contained immutably during the operation of the dishwasher in each wash program, the measures would have to be limited so that their disadvantages could also be accepted if a particular shine effect is not wanted at all by the consumer. In the inventive dishwasher on the other hand such considerations have no part to play, since the possible disadvantages of the adaptation measures do not occur at all if the user does not enter the operating command provided for their activation to carry out adaptation measures for achieving the desired particular shine effect or cancels said command.

The shine effect improved in this way means the demands of users are better met.

The operating command for carrying out adaptation measures for improving the avoidance of spots on cleaned items and/or the drying result on items can act on one or more of the wash programs provided. In such cases different adaptation measures can be effected for different wash programs by the operating command. It is also possible to provide a number of operating commands for carrying out adaptation measures for improving the avoidance of spots on cleaned items and/or the drying result on items, which trigger different adaptation measures in the same wash program, in order to enable the intensity of the shine effect to be able to be adapted more precisely to the requirements of the users.

According to an advantageous development of the invention, the operating command for executing adaptation measures is able to be entered via an operating element provided exclusively for the purpose. This improves operating convenience, which further satisfies the demands of the users. In addition incorrect operation can be avoided in this way. The operating element can for example involve a separate button which is arranged on an operating panel of the dishwasher. It is however basically also possible to provide operating elements which are already intended for other operating commands for entering the operating command for carrying out adaptation measures. Multifunction buttons, rotary knobs, touchscreens, alphanumeric input units and more such facilities are conceivable.

In accordance with an expedient development of the invention, one of the adaptation measures causes at least one part wash cycle provided as an intermediate rinse cycle to be carried out during the wash cycle, i.e. at least two intermediate rinse cycles are carried out for the selectively chosen "shine drying" wash cycle. This results in better rinsing off of soiling and/or washing agents on the items to be washed, which counteracts the formation of spots on the cleaned items and thus leads to a greater shine on the items to be washed.

In accordance with an expedient development of the invention one of the adaptation measures brings about an increase in the quantity of washing fluid used in a part wash cycle intended as a final rinse cycle, with the increase amounting to at least 20%, preferably at least 30%, preferably at least 40% of the regular or original quantity of the respective washing fluid which is provided during a wash cycle without shine drying for this final rinse cycle. The increase in the quantity of the washing fluid used in the final rinse cycle leads to an additional dilution of the soiling and/or washing agent residues contained in the washing fluid, which counteracts the formation of spots on the cleaned items and thus leads to a greater shine on the washed items. With the said minimum values for increasing the amount a significant improvement in the shine on the washed items has already been produced.

In accordance with an advantageous development of the invention one of the adaptation measures causes rinse aid to be added to the washing fluid used there during at least one part wash cycle provided as an intermediate rinse cycle. The surface tension of the washing fluid is reduced by this so that, at the end of the intermediate rinse cycle a greater proportion of the washing fluid loaded with soiling and/or washing agent residues drains away and/or drips off the items, so that a greater proportion and the soiling and/or washing agent residues contained therein can be pumped away, which counteracts the formation of spots on the cleaned items and thus leads to a high shine on the washed items.

In accordance with an advantageous development of the invention one of the adaptation measures causes a heating phase to be extended, with the extension amounting to at least 10%, preferably at least 20%, especially preferably at least 30% of the original or regular duration of the heating phase which is provided in a wash cycle without "shine drying", and/or to carrying out the least one additional heating phase during a part wash cycle provided as a final rinse cycle before the addition of rinse aids to a washing fluid used there. Some rinse aids tend to foam heavily in a relatively cold washing liquor with a temperature of for example less than 35° C. It is precisely when a number of unheated intermediate rinse cycles are carried out that the critical temperature in respect of foam formation of the washing fluid in the final rinse cycle can be greatly undershot. By a heating phase provided in any event before the addition of the rinse aid for the washing fluid of the final rinse cycle being extended, which can especially be provided for an intended self-drying for drying the items to be washed and/or by an additional heating phase being provided before the addition of the rinse aid, which can especially be provided for an intended drying of the items by an especially dry hot air flow, foaming can be securely prevented. This enables the washing fluid of the wash cycle to wet the items to be washed evenly, which counteracts the formation of spots on the cleaned items and thus leads to a high shine on the items.

In accordance with an expedient development of the invention one of the adaptation measures courses an extension of a duration of a part wash cycle provided as a drying cycle, with the extension amounting to at least 10%, preferably at least 20%, especially preferably at least 30% of the original or regular duration of the drying cycle provided for a washing program without shine drying. By increasing a duration of the drying cycle an improvement in the drying effect is achieved, whereby in this way hollow vessels in particular, such as drinking glasses, can be better dried and thus the shine effect is more evident. With the said minimum values for the extension a significant improvement in the drying effect already occurs.

In accordance with an advantageous development of the invention one of the adaptation measures causes a modification of at least one pump-off sequence for pumping away a washing fluid of a part wash cycle by means of a drain pump from the dishwasher, with a residual quantity of washing fluid not pumped off being reduced in the modified pump-off sequence. By reducing the residual quantity of washing fluid not able to be pumped out, in particular a transfer of soiling and/or washing agents from the washing fluid used before the pump-off sequence into a washing fluid used after the pump-off sequence can be reduced. This enables the soiling content and/or the washing agent content of the washing fluid used last in a wash cycle to be reduced, which reduces the formation of spots on the cleaned items. The cleaned items are thus given an especial shine, in particular if cutlery or glassware is involved.

In accordance with an advantageous development of the invention the pump-off sequence includes at least one pump-off phase during which the drain pump is switched on or is running at high speed, whereby the modified pump-off sequence involves at least one additional pump-off phase during which the drain pump is switched on is getting up to speed, with the additional pump-off phase during which the drain pump is switched off or is reducing its speed, being separated from the preceding pump-off phase in each case, i.e. is spaced from it in time.

Usually the drain pump is embodied as a rotary pump, especially a radial pump, a half-radial pump or an axial pump. A rotary pump in this case is a continuous-flow machine, in which the respective liquid is conveyed by means of a rotating impeller element using centrifugal force. The embodiment of the drain pump as a centrifugal pump leads, in improved manner or other than for example in an embodiment as a piston pump, to the function of the drain pump even being ensured when the washing fluid to be pumped away is heavily soiled.

If such a drain pump is switched on, the amount of washing fluid to be found in the dishwasher initially reduces essentially linearly, with the speed remaining constant over time. When the amount of washing fluid falls below a specific residual amount such an amount of air gets into the circulating pump however that the pressure for conveying washing fluid collapses and consequently no more washing fluid is conveyed. In this way a residual amount of washing fluid not able to be pumped away in continuous operation of the drain pump remains in the dishwasher.

Surprisingly it has now been shown that by automatic execution of a pump-off sequence, which, especially in relation to the pump-off sequence used in the washing programs without "shine drying", includes at least one further pump-off phase during which the drain pump is switched on, whereby the further pump-off phase is separated by a pause during which the drain pump is switched off from a preceding pump-off phase, enables a residual amount of washing fluid which cannot be pumped offhand which remains in the dishwasher to be considerably reduced.

The effect which leads to the reduction of the residual amount of washing fluid not pumped offish not definitively clarified. It has been shown however that on start-up of the circulating pump after a pause even then at least for a short time a pressure for conveying washing fluid is built up if the residual amount of washing fluid not able to be pumped off during the continuous operation of the drain pump is undershot. The effect which leads to the reduction of the residual amount washing fluid not pumped off and which does not play a role in the first of the pump-off phases because of the large amount of washing fluid still there, occurs however as an unexplained cause not only in a second pump-off phase but also in a third pump-off phase and possibly in further pump-off phases of the pump-off sequence. This is a surprise insofar as the amount of washing fluid additionally able to be pumped off by the starting up of the drain pump must actually have been pumped off after the second pump-off phase. Accordingly however, by the provision of an additional pump-off phase in the modified pump-off sequence, a reduction in the non-pumped-off residual amount of washing fluid can be achieved regardless of whether one or more pump-off phases is provided in the original pump-off sequence.

According to an advantageous development of the invention the respective, modified pump-off sequence features a total of three pump-off phases. By carrying out at least three pump-off phases the described effect can be used multiple times so that the residual amount of washing fluid not pumped off can be reduced especially greatly. These at least three pump-off phases following each other with forces in time of the respective pump-off sequence corresponds to a "stuttering pump-off" of the drain pump.

According to an advantageous development of the invention the first pump-off phase is intended for pumping away at least 80%, preferably at least 90%, especially preferably at least 95% of the total amount of washing fluid to be pumped out. This makes it possible, by means of the subsequent pump-off phases to effectively reduce the residual quantity of washing fluid remaining in the dishwasher.

In accordance with an expedient development of the invention, in the pump-off sequence and/or the modified pump-off sequence the first pump-off phase of the pump-off phases is designed the pump-off a quantity of washing fluid able to be pumped off in continuous operation of the drain pump. In this way it is possible, by means of the subsequent pump-off phases, to reduce the residual quantity of washing fluid remaining in the dishwasher especially effectively.

In accordance with an expedient development of the invention a monitoring device is provided for monitoring a flow of washing fluid conveyed by the drain pump, whereby in the pump-off sequence and/or the modified pump-off sequence there is provision for aborting the first pump-off phase of the pump-off phases if an undershoot of the minimum value for the washing fluid flow is detected by the monitoring device. If a minimum value for the quantity of washing fluid pumped off per unit of time, i.e. for the washing fluid flow conveyed is undershot, this indicates that the quantity of washing fluid able to be pumped off in continuous operation of the drain pump is substantially pumped out. If on the basis of this criterion and the bought of the first pump-off phase is initiated, it can be ensured that on the one side the quantity of washing fluid able to be pumped off to all in the first pump-off step is essentially reached and that on the other hand an unnecessary duration of the first pump-off phase is avoided.

In accordance with an expedient development of the invention the drain pump has an electric motor, whereby the monitoring unit is embodied for monitoring at least one electrical operating parameter of the electric motor. This is based on the knowledge that electrical operating parameters of electric motors of drain pumps change characteristically as a function of the flow of washing fluid conveyed. For a drain pump operated with a fixed voltage for example, this applies to its current or power consumption respectively. Thus, at a given speed, the power consumption of a drain pump sucking in air is generally far above the power consumption of a drain pump essentially sucking in washing fluid. Such a monitoring unit is easily constructed in such cases. This applies especially by comparison with monitoring units having a specific through-flow meter, for example an impeller meter.

In accordance with an expedient development of the invention there is provision for aborting the first pump-off phase of the pump-off phases in the pump-off sequence and/or the modified pump-off sequence if it is established by the monitoring device, after a predetermined period of time has expired, that the minimum value for the flow of washing fluid has not been undershot. In this way the first pump-off phase can be prevented from being continued indefinitely in the event of a malfunction of the monitoring device.

According to an advantageous development of the invention at least one of the pump-off phases following on from the first pump-off phase and/or at least one of the pauses is aborted in the pump-off sequence and/or the modified pump-off sequence under time control. In this way the intended pump-off sequence can be realized in a simple manner, especially without additional sensors.

In accordance with an expedient development of the invention at least one of the pauses has the duration of at least 1 second in the pump-off sequence and/or the modified pump-off sequence, preferably of at least 2 seconds, especially preferably of a least 4 seconds and/or of at most 24 seconds, preferably of at most 12 seconds, especially preferably of at most 6 seconds. The specified minimum values for the duration of the pauses are sufficient under normal circumstances for the washing fluid headed in the preceding pump-off phase in the drain pump to reach a rest position in the respective pause, through which at least one short-term pressure buildup is possible by starting up the drain pump. The specified highest values continue to ensure that the overall pump-off sequence does not last longer than required.

According to an expedient development of the invention, in the pump-off sequence and/or the modified pump-off sequence, at least one of the pump-off phases following the first pump-off phase has a duration of at least 1 second, preferably of at least 2 seconds, especially preferably at least 4 seconds and/or of at most 32 seconds, preferably of that most 16 seconds, especially preferably of at most 8 seconds. With the specified minimum values for the duration of the pump-off phases following the first pump-off phase, the additional maximum quantity of washing fluid able to be pumped off on starting up the drain pump can generally be achieved in each of the subsequent pump-off phases. The specified highest values continue to ensure that the overall pump-off sequence does not last longer than required.

In accordance with an expedient development of the invention the modification in a pump-off sequence is undertaken at the end of a part wash cycle provided as an intermediate rinse cycle. Right at the end of a part wash cycle provided as an intermediate rinse cycle a reduction in the non-pumped-off quantity of washing fluid leads to a reduction in the transfer of washing agents and/or soiling in the last washing fluid of a wash cycle, which in every likelihood is the washing fluid of a part wash cycle embodied as a final rinse cycle. This enables the shine effect on the washed items to be increased especially effectively.

In accordance with an advantageous development of the invention the modification in a pump-off sequence is undertaken at the end of a part wash cycle provided as a cleaning cycle. In this way in general a transfer of washing agents and/or soiling into an intermediate rinse cycle can be prevented, so that the washing fluid in this intermediate rinse cycle contains less washing agents and/or soiling. This enables a further transfer of washing agents and/or soiling into the last washing fluid of a wash cycle to be further minimized and the shine effect on the washed items to be increased.

According to an advantageous development of the invention there is no provision for the modification during a pump-off sequence at the end of a part wash cycle intended as a pre-wash cycle. At the end of a normal pre-wash cycle a greater quantity of soiling generally adheres to items to be washed. Since this is normally loosened in the subsequent cleaning cycle, there is no danger of the possible transfer of soiling through the non-pumped-off washing fluid from the pre-wash cycle into the cleaning cycle. Thus at the end of a pre-wash cycle a modification of the pump-off sequence can readily be dispensed with, which speeds up the execution of the wash cycle.

In accordance with an advantageous development of the invention there is no provision for modification in a pump-off sequence at the end of a part wash cycle intended as a final rinse cycle. At the end of a final rinse cycle the washing fluid used is essentially free from washing agents and/or soiling. A transfer of washing agents and/or soiling into a later wash cycle is in any event thus possible to a small extent and is not disruptive. Thus at the end of a final rinse cycle modification of the pumping off sequence can be readily dispensed with, which further speeds up the execution of the wash cycle.

In accordance with an expedient development of the invention the drain pump comprises a brushless electric motor, preferably a brushless permanent magnet motor. The brushless electric motor can especially be embodied as a brushless DC motor also referred to as a BLDC motor, as a brushless AC motor, also referred to as a BLAC motor, or as a synchronous motor. The rotor of the motor in such cases includes a least one permanent magnet, while the stator features a number of electromagnets. The electromagnets in such cases are commutated via control electronics. By comparison with other possible motor concepts, a defined start-up of the motor from standstill can be achieved by this design so that, in the pump-off phases following on from the first pump-off phase the quantity of washing fluid able to be additionally pumped off can be maximized.

According to an advantageous development of the invention a circulating pump for applying washing fluid to items to be washed is switched off during the entire duration of the pump-off sequence and/or of the modified pump-off sequence. This prevents washing fluid being distributed by the circulating pump into the dishwasher during the pump-off sequence and/or the modified pump-off sequence so that said fluid is not able to be pumped off by the drain pump.

In accordance with a further expedient development of the invention one of the adaptation measures, in at least one part wash cycle provided as an intermediate rinse cycle, causes an extension of a period of time between a circulating sequence for circulating the washing fluid and a pump-off sequence for pumping off the washing fluid. In this way a greater part of the washing fluid adhering to the items to be washed can drip off and/or drain away so that a larger part of the washing fluid and the soiling and/or washing agent residues contained therein can be pumped away which counteracts the formation of spots on the cleaned items and leads to a greater shine on the items.

According to an advantageous development of the invention at least one adaptation measure provided for entry of an operating command for carrying off the adaptation measures is omitted if a dispensing device for adding rinse aid to the washing fluid is deactivated or if a fill level of rinse aid in the dispensing device falls below a minimum fill level. For a manual deactivation of the dispensing device for adding rinse aid to the washing fluid or if the user does not put any rinse aid into the dispensing device, it can be assumed that a washing agent is being used into which rinse aid is integrated. This can involve so-called multifunction tabs. These are usually inserted into a dispensing device for adding washing agent and are released automatically during a cleaning cycle of a wash cycle. In such cases the rinse aid contained therein essentially dissolves in the washing fluid of the cleaning cycle. A small part of the dissolved rinse aid then gets into the final rinse cycle, by transfer for example via the amount of washing fluid that cannot be pumped away from part cycle to part cycle, in order to perform its surface tension reducing function there. In order to now maintain this desirable transfer, one or a number of the adaptation measures provided can be dispensed with, in order in the adapted wash program to minimize a deterioration in the shine effect as a result of doing without a separate rinse aid.

For example an intended addition of rinse aid to a washing fluid used there, a modification of at least one pump-off sequence for pumping off a washing fluid of a part wash cycle, an increase in a quantity of a washing fluid used in a final rinse cycle, an execution of an additional intermediate rinse cycle and/or an extension of a period of time in an intermediate rinse cycle between a circulating sequence for circulating the washing fluid and a pump-off sequence for pumping off the washing fluid can be dispensed with.

The invention also relates to a method for operating a dishwasher, especially a household dishwasher, with a control device in which at least one wash program for controlling a wash cycle comprising a number of part wash cycles for cleaning and/or drying of items to be washed is stored and with an operating device for entering operating commands for the control device, which is characterized in that one or more adaptation measures are carried out on at least one of the wash programs such that the avoidance of spots on the items to be washed and/or the drying results on the items to be washed is improved during the execution of the wash cycle based on the adapted wash program, if an operating command provided for the purpose of carrying out adaptation measures is entered at the operating device.

The inventive method makes it possible to use the dishwasher in a flexible manner as well as reduce the formation of spots on the cleaned dishes.

Other advantageous embodiments and/or developments of the invention emerge from the subclaims.

The present advantageous embodiments and/or developments of the invention as well as the advantageous developments of the invention to be found in the dependent claims can be provided individually or in any given combination with one another in the inventive dishwasher.

BRIEF DESCRIPTION OF THE DRAWINGS

The invention and its developments, as well as their advantages, are explained in greater detail below with reference to figures. The respective drawings show the following schematic diagrams.

DETAILED DESCRIPTION OF EXEMPLARY EMBODIMENTS OF THE PRESENT INVENTION

Figure 1:
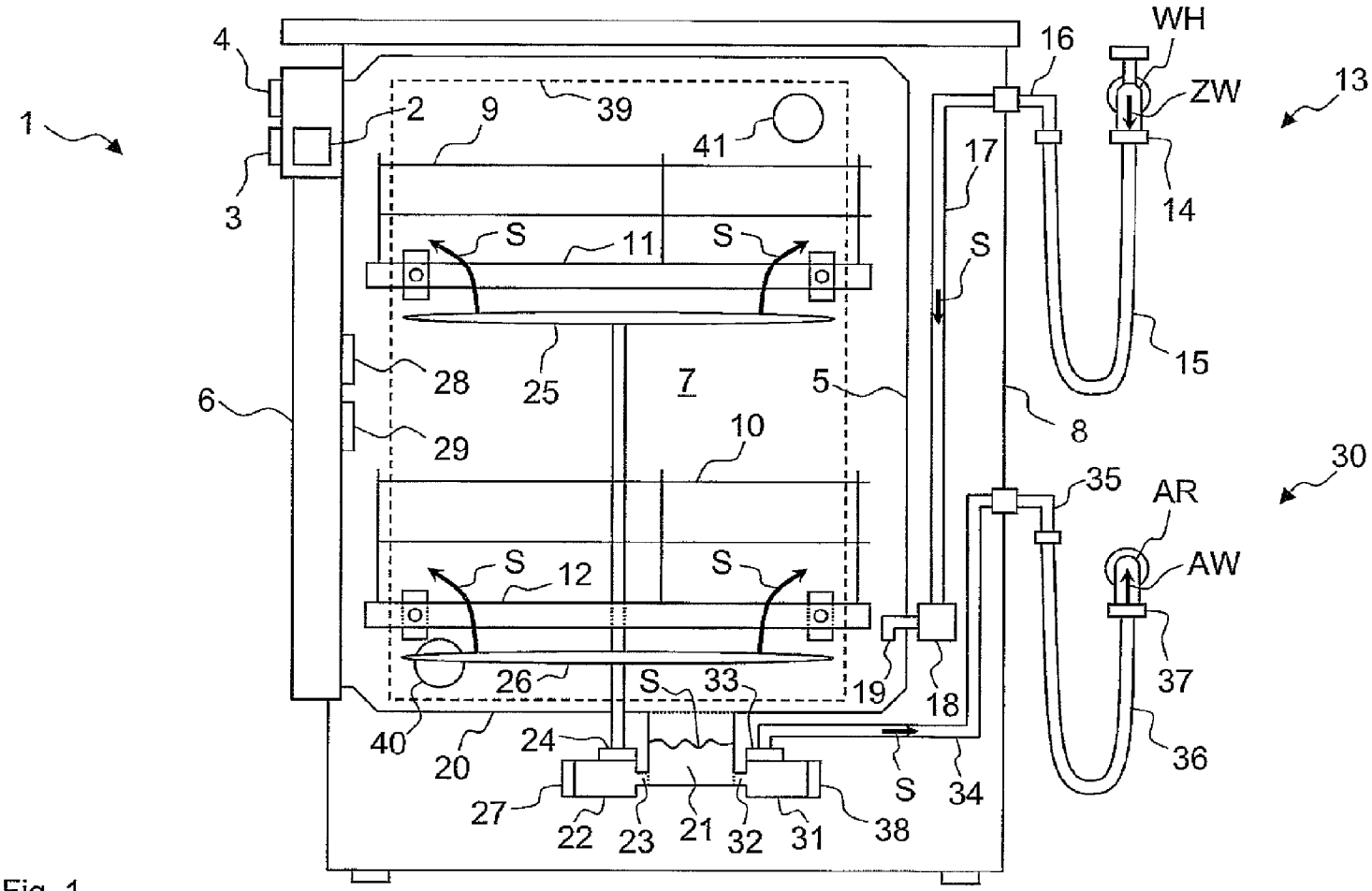
FIG. 1 an advantageous embodiment of an inventive household dishwasher in a schematic view from the side, FIG. 2 a block diagram of the household dishwasher from FIG. 1, FIG. 3 a schematic diagram of a wash cycle carried out on the basis of a wash program as well as a wash cycle carried out on the basis of an adapted wash program in the timing of the household dishwasher of FIGS. 1, 2, FIG. 4 a schematic diagram of a pump-off sequence of the dishwasher of FIGS. 1 and 2, as well as FIG. 5 a schematic diagram of a modified pump-off sequence of the dishwasher of FIGS. 1 and 2.

Parts that correspond to one another are provided with the same reference characters in the figures below. In such cases only those components of the dishwasher as are necessary for understanding the invention are provided with reference characters and explained. It goes without saying that the inventive dishwasher can comprise further parts and modules.

FIG. 1 shows an advantageous exemplary embodiment of an inventive household dishwasher 1 in a schematic side view. The dishwasher 1 comprises a control device 2 in which at least one wash program for controlling a wash cycle for washing items to be washed, especially dishes, is stored. Expediently a number of wash programs are stored in this case so that, by selecting a suitable wash program, the execution sequence of a wash cycle controlled by the control device 2 can be adapted for example to the amount of load, to the type of load and/or to degree of soiling of the items to be washed.

Assigned to the control device 2 is an operating device 3 which is connected to the control device 2 such that a user of the dishwasher 1 can enter operating commands at the control device 2. An operating command in this case is to be understood as information which acts in a planned manner on the function of the control device. In this case for example an operating command for manually selecting a wash program as well as an operating command for starting a selected wash program can be provided.

In the inventive dishwasher 1 an improvement in avoiding spots on the cleaned items and/or in the results for drying the items is now possible which leads to a particular shine effect on the cleaned and dried items, especially if dishes, preferably glassware or metal pots or metal cutlery, are involved. This is referred to within the context of the invention as "shine drying".

The improvement is achieved here by using at least one adaptation measure on at least one of the wash programs. In this case the at least one adaptation measure is able to be executed manually via an operating command able to be entered at the operating device 3 for carrying out adaptation measures.

The operating device 3 can be embodied so that the operating command for executing adaptation measures is able to be entered via an operating element provided exclusively for the purpose. This improves operating convenience, which further satisfies the demands of the users. Operating errors can also be avoided in this way. The operating element can for example involve a separate button which is arranged on an operating panel of the dishwasher 1. It is however basically also possible to provide operating elements which are already intended for other operating commands for entering the operating command for carrying out adaptation measures. Multifunction buttons, rotary knobs, touchscreens, alphanumeric input units and more such facilities are conceivable.

The control device 2 is further assigned an output device 4, which makes it possible to output messages to the user. The output device 4 can have indicator lamps, light emitting diodes, an alphanumeric display and/or a graphical display, especially for output of optical or visual messages. In addition or independently, the output device 4 can have a buzzer, a loudspeaker and/or the like for output of acoustic messages.

The dishwasher 1 further comprises a washing container 5 able to be closed off by a door 6, so that a closed washing compartment 7 for washing items is produced. The washing container 5 can be arranged in such cases if necessary inside a housing 8 of the dishwasher 1. The housing 8 is not necessary, especially with built-in dishwashers, and can be sometimes be omitted completely. The door 6 is shown in its closed position in FIG. 1. The door 6 is able to be moved into an open position by pivoting it around an axis arranged vertically to the plane of the drawing, in which position it is aligned substantially horizontally and makes it possible to insert or remove items to be washed. In the exemplary embodiment shown in FIG. 1 the operating device 3 is arranged in a user-friendly manner in an upper section of the door 6. The output device 4 is likewise arranged in an upper section of the door 6 so that optical or visual messages are easily visible and/or acoustic messages are easily audible. The control device 2 is also positioned there so that the necessary signal connections between the operating device 3, the output device 4 and the control device 2 can be kept short. In principle it is possible however to arrange the operating device 3, the output device 4 and/or the control device 2 at another position. In particular the control device can, in accordance with an alternate embodiment variant, be accommodated if necessary in a floor module below the washing container. The control device 2 can also be embodied as a decentralized device, which means that it comprises spatially-distributed components which are connected via communication means such that they can interoperate.

The dishwasher 1 has an upper crockery basket 9 and a lower crockery basket 10 for positioning items to be washed, such as crockery. The upper crockery basket 9 is arranged in this case on telescopic rails 11 or other telescopic means which are each attached to opposite side walls of the washing container 5 extending in the depth direction of the washing container. The crockery basket 9 is able to be moved out of the washing container 5 by means of the telescopic rails 11 when the door 6 is open, which facilitates loading or unloading of the upper crockery basket 9. The lower crockery basket 10 is arranged in a similar manner on telescopic rails 12.

The wash program or programs stored in the control device 2 can each provide a number of part wash cycles, for example in this chronological sequence at least one pre-wash cycle, at least one cleaning cycle, at least one intermediate rinse cycle, at least one final rinse cycle and/or at least one drying cycle. In this case pre-wash cycle, cleaning cycle, intermediate rinse cycle and rinse cycle are referred to as water-conducting part wash cycles, since during their execution the items to be washed positioned in the washing compartment 7 are treated with a washing fluid S. During the drying cycle there is generally no provision for treatment of the washed items with washing fluid S.

Fresh water or supply water ZW can be used as washing fluid S for treating the items to be washed in the exemplary embodiment, which can be taken from an external water supply device WH, especially a drinking water supply network, and let into the washing compartment 7. Typically in such cases at the beginning of each water conducting part wash cycle a washing fluid S formed from fresh inlet water ZW is supplied, which is then drained off as waste water AW at the end of the respective part wash cycle to an external waste water disposal device AR. It is however also possible to store a washing fluid S of a part wash cycle in a storage container not shown in the figure and to supply it to the washing compartment 7 again in a later part wash cycle.

The dishwasher 1 of FIG. 1 in this case comprises a water inlet device 13 which is intended to be connected to an external water supply device WH. As in FIG. 1 the external water supply device WH can involve a water faucet WH of a building-side water installation which provides inlet water ZW under pressure. The water inlet device 13 includes a connecting piece 14 which is intended to be connected to the water faucet WH. The connection can typically be made via a screw thread arrangement, a bayonet arrangement or the like. Downstream from the connecting piece 14 a connecting hose 15 is provided which is preferably embodied as a flexible hose. The downstream end of the connecting hose 15 is provided with a connecting piece 16 fixed to the housing.

A supply line 17 is provided downstream from the connection piece 16 fixed to the housing which is connected to an input side of an inlet valve 18 able to be switched by means of the control device 2. An output side of the inlet valve 18 in its turn is connected to a fluid inlet 19 of the washing compartment 7. In this way it is possible by means of the water inlet device 13 to direct inlet water ZW as a washing fluid S into the inside of the washing compartment 7 of the dishwasher 1. The inlet valve 18 can be embodied as a switchable magnetic valve in this case which has only an open position and a closed position. In the supply line 17 a water processing system, for example a softening system not shown in the diagram, can be provided.

Instead of or in addition to the device-side inlet valve 18, an external inlet valve can also be provided between the connecting piece 14 and the water faucet WH, especially a so-called Aquastop valve, which is preferably able to be switched by means of the control device, especially able to be blocked or opened.

The washing fluid S that has reached the washing compartment 7 via the fluid inlet 19, because of its gravitational force, arrives in a collection device 21, which can preferably be embodied as a reservoir 21, embodied on a floor 20 of the washing container 5. For conveying liquid, a circulating pump 22 is connected to the collection device 21 in this case by its inlet 23. Also in the exemplary embodiment an output side of the circulating pump 22 is connected, via a preferably electrical heating device 24 for heating washing fluid S, to a spray device 25, 26 which makes it possible to apply washing fluid S heated if necessary to the items to be washed introduced into the washing container 7. In the exemplary embodiment of FIG. 1 the spray device 25, 26 comprises an upper rotatable spray arm 25 and a lower rotatable spray arm 26. However fixed spray elements or other spray devices could be provided as an alternative or in addition.

The washing fluid S exiting from the spray device 25, 26 with the circulating pump 22 switched on, as a result of its gravitational force within the washing compartment 7, arrives back in the collection device 21. During the recirculation of the washing fluid S in the washing compartment 7 the aim is to operate the circulating pump 22 in true running mode. The circulating pump 22 is running in true running mode when its inlet 23 in cross-section is filled completely with washing fluid S, so that exclusively washing fluid S, or expressed conversely no air, gets into the inside of the circulating pump 22. The operation of the circulating pump 22 in true running mode on the one hand allows sufficient pump pressure to be achieved for an intended cleaning effect and on the other hand enables the generation of irritating slurping noises to be avoided. In order to now determine whether the circulating pump 22 is in true running mode or not it is assigned a true running monitoring unit 27. This can be provided as a separate component or if necessary also be a component of the control device 2. If during the recirculation of washing fluid by means of the true running monitoring unit 27 a non-true running of the circulating pump 22 is detected, the collection device 21 can for example be filled up with additional washing fluid S by opening the inlet valve 18, so that the fill level of washing fluid S in the collection device 21 rises and the circulating pump 22 runs true as a result.

The dishwasher 1 also features a dispensing device 28 in a conventional manner which makes it possible to supply the washing fluid S introduced into the washing compartment 7 with washing agents and/or cleaning aids in order to improve the cleaning effect and/or the drying effect of a wash cycle. A further dispensing device 29 also makes it possible to provide the washing fluid S with especially liquid rinse aids in order in particular to avoid formation of spots on the cleaned items as well as to increase a drying effect of a wash cycle.

The dishwasher 1 shown in FIG. 1 also features a drain device 30 which is used to pump the washing fluid S no longer needed out of the washing compartment 7 as waste water AW. The drain device 30 comprises a drain pump 31 of which the inlet 32 is connected to the collection device 21. The output side of the drain pump 31 on the other hand is connected via a check valve 33 to a connection line 34 of which the downstream end is connected to a connection 35 of the dishwasher 1 fixed to the housing. Attached to an outlet of the connector 35 fixed to the housing is a drain hose 36 which is especially embodied as flexible. Arranged at the downstream end of the drain hose 36 is a connecting piece 37 which is intended to connect the drain device 30 to a waste water disposal device AR. The waste water disposal device AR can be a drain pipe AR or a building-side water installation. The connection between the connecting piece 36 and the drain pipe AR can be embodied as a screw thread connection, as a bayonet connection, as a plug-in connection or the like.

In this way it is possible to drain washing fluid S no longer needed, especially soiled washing fluid S, from the collection device 21 into the waste water disposal device AR, whereby the check valve 33, which can typically be embodied as a flap-type check valve 33 prevents washing fluid S already pumped off of the collection device 21 and/or liquid stemming from the waste water disposal device AR getting into the collection device 21 as a result of its gravitational force and/or through pressure fluctuations in the waste water disposal device AR.

The drain pump 31 is preferably assigned a monitoring device 38 for monitoring a quantity of washing fluid S is conveyed per unit of time, i.e. to monitor the conveyed washing fluid flow. The monitoring device 38 makes it possible to detect for example, when during pumping off of washing fluid S from the collection device 21, the fill level of washing fluid S in the collection device 21 has fallen so far that no washing fluid S is being conveyed any longer.

The drain pump 31 here in the exemplary embodiment has an electric motor, whereby the monitoring unit 38 is embodied for monitoring at least one electrical operating parameter of the electric motor. This is based on the knowledge that electrical operating parameters of electric motors of drain pumps 31 change characteristically as a function of the flow of washing fluid conveyed. This typically applies for a drain pump operated with a fixed voltage for its current or power consumption. Thus, at a given speed the power consumption of a drain pump sucking in air is generally far above the power consumption of a drain pump 31 essentially sucking in washing fluid. Such a monitoring unit 38 is easily constructed in such cases. This applies especially by comparison with monitoring units having a specific throughflow meter, for example an impeller meter.

The electric motor of the drain pump 31 can especially comprise a brushless electric motor, preferably a brushless permanent magnet motor. The brushless electric motor can especially be embodied as a brushless DC motor also referred to as a BLDC motor, as a brushless AC motor, also referred to as a BLAC motor, or as a synchronous motor. The rotor of the motor in such cases includes a least one permanent magnet, while the stator features a number of electromagnets. The electromagnets in such cases are commutated via control electronics. By comparison with other possible motor concepts, a defined start-up of the motor from standstill can be achieved by this design, so that in the pump-off phases following on from the first pump-off phase the quantity of washing fluid able to be additionally pumped off can be maximized.

The dishwasher 1 of FIG. 1 further comprises a sorption drying device 39 shown only schematically in FIG. 1 which makes it possible to guide air in a circuit over a sorption column not shown in the diagram, to introduce it via an opening 40 into the washing compartment 7 and to remove it via a further opening 41 from the washing compartment 7 in order to route it back past the sorption column. In this case moisture to be found in the air is deposited on the sorption column so that the air is dehumidified. The air also heats up during the dehumidifying process so that air introduced into the washing compartment 7 is dry and warm. The sorption device 39 is especially intended, during a drying cycle of a wash cycle, to dry the items in a drying sequence by means of the dried and heated air. In order to remove the moisture deposited on the sorption column again, the sorption column is provided with a heater not shown in the diagram by means of which the sorption column is heated up during a regeneration sequence such that the moisture is released again from the sorption column. The regeneration sequence can be executed especially during a cleaning cycle of a wash cycle, whereby the waste heat of the regeneration sequence can be used to heating up a washing fluid of the cleaning cycle which lowers the energy required and of the heating device 24 assigned to the circulating pump 22.

Figure 2:
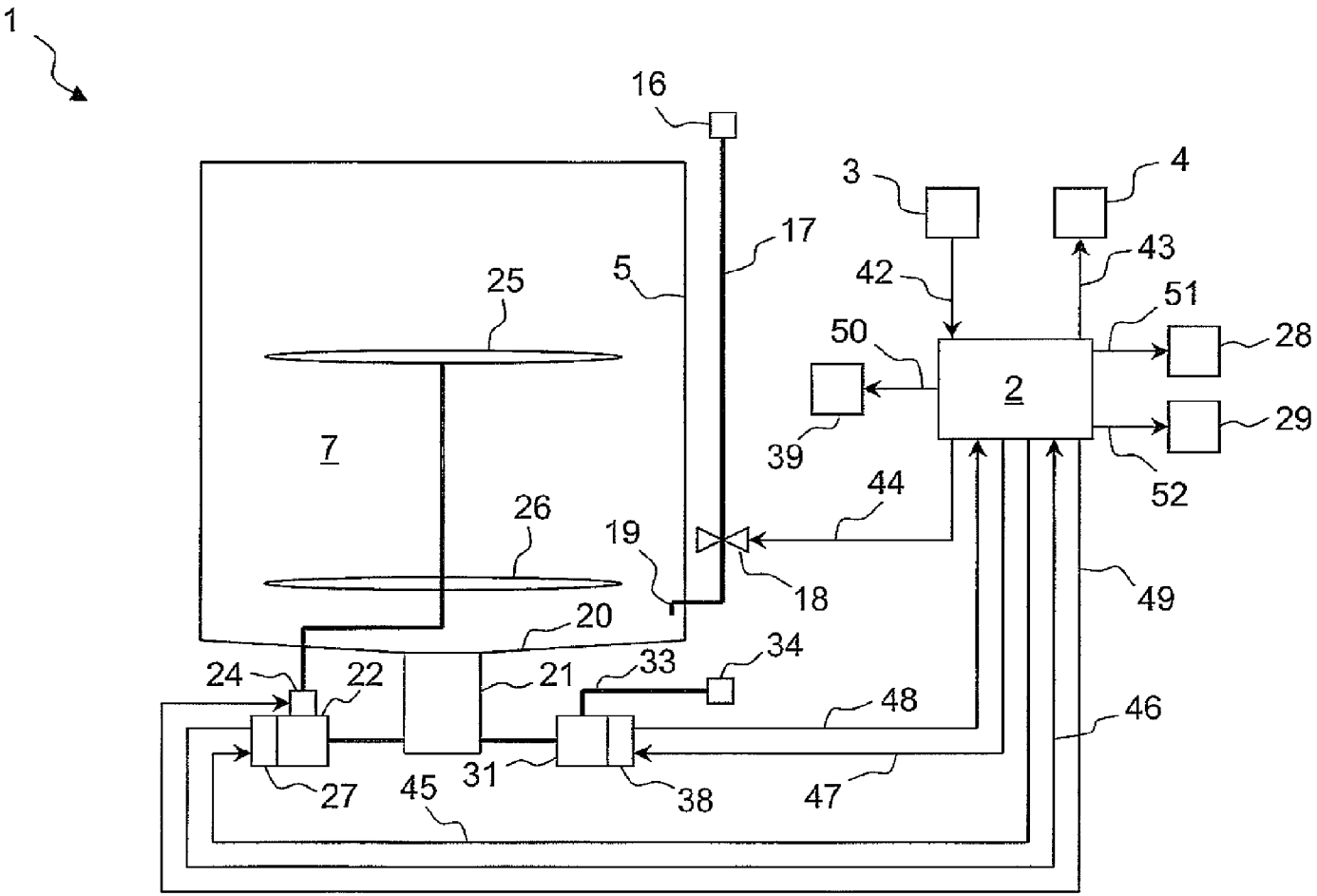

FIG. 2 shows a block diagram of the household dishwasher 1 of FIG. 1, whereby the control and communication concept in particular is presented in this figure. In the exemplary embodiment a signal line 42 is provided which connects the operating device 3 to the control device 2 such that operating commands of a user are able to be transmitted from the operating device 3 to the control device 2. Furthermore a signal line 43 is provided which connects the control device 2 to the output device 4, so that information provided by the control device 2 can be transmitted to the output device 4 and output there to the user.

Furthermore a control line 44 is provided, which connects the control device 2 to the switchable inlet valve 18 such that the inlet valve 18 can be closed or opened respectively by the control device 2. In this way the filling of the washing compartment 7 with washing fluid S can be controlled by the control device 2. A further control line 45 connects the control device 2 to the circulating pump 22. This enables the circulation of washing fluid S in the washing compartment 7 to be adjusted by the control device 2, especially to be controlled or regulated.

Furthermore a signal line 46 is provided which connects the true running monitoring unit 27 to the control device 2. The signal line 46 makes it possible to transmit to the control device 2 information generated by the true running monitoring unit 27 relating to the running characteristics of the circulating pump 22. In this case the control device 2 is embodied so that, when it switches, especially controls the closing and/or opening times, if necessary also controls or regulates the inlet valve 18, this information can be taken into account by the true running monitoring unit 27. The true running monitoring device can in this case especially be embodied as a functional component of the control device.

In addition a control line 47 is provided which connects the control device 2 to the drain pump 31 so that the drain pump 31 is also able to be switched by the control device 2, especially switched off and switched on, and is optionally also able to be controlled or regulated. A further signal line 48 connects the monitoring device 38 assigned to the drain pump 31 to the control device 2 such that the information generated by the monitoring device 38 can be taken into account by the control device 2 as the wash cycles are being carried out.

A further control line 49 connects the control device 2 to the heating device 24 assigned to the circulating pump 22 in the exemplary embodiment such that the heating device 24 can be used as required by the control device 2 during the course of a wash cycle.

A further control line 50 which connects the control device 2 and the sorption drying device 39 also makes it possible for the control device 2 to control and/or to regulate the operation of the sorption drying device 39.

The addition of washing agents to a washing fluid can further be influenced by the control device 2 via a further control line 51 which connects the control device 2 and the dispensing device 28.

The addition of washing agent to a washing fluid can likewise be influenced by the control device 2 via a further control line 52, which connects the control device 2 and the dispensing device 29.

Figure 3:
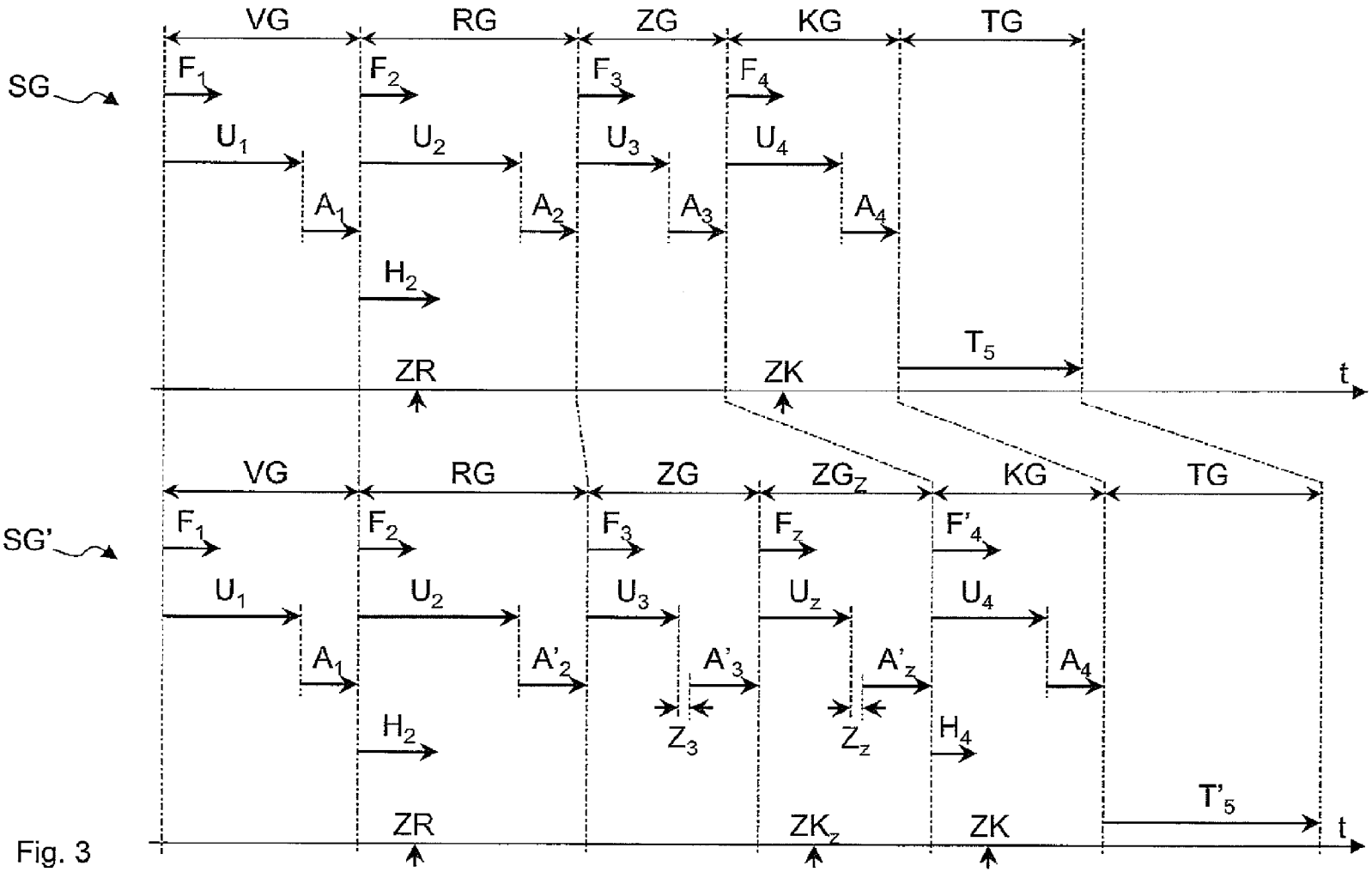

FIG. 3 shows a typical wash cycle SG based on one of the wash programs of the inventive dishwasher 1. In addition FIG. 3 shows an adapted or modified wash cycle SG', which is carried off on the basis of a wash program manually adapted by an operating command and which brings about a particular shine effect on the cleaned and dried items, especially by reduced transfer of soiling and/or washing agents into the last washing fluid amounts S used in the wash cycle. Here in the exemplary embodiment this is the bath amount during the final rinse cycle of the wash cycle. The usual or regular wash cycle SG (without shine drying) comprises a number of part wash cycles, namely in the following chronological order: A pre-wash cycle VG to pre-clean items to be washed, a cleaning cycle RG for fully cleaning items to be washed, and intermediate rinse cycle ZG for removing soiled washing fluid S from the items to be washed, a final rinse cycle KG for avoiding spots on the washed items and a drying cycle TG for drying the washed items. Basically the individual cycles of the part wash cycles given above, for example the pre-wash cycle VG, could be omitted. Likewise additional part wash cycles, for example a second intermediate rinse cycle, could be provided.

At the beginning of the pre-wash cycle VG a fill sequence $F_1$ is carried out for filling the washing compartment 7 with washing fluid S. When this is done the fill valve 18 is opened for a time in the exemplary embodiment. Likewise at the beginning of the pre-wash cycle VG a circulating sequence $U_1$ is carried out in which circulated washing fluid S is applied to the items to be washed. For this purpose the circulating pump 31 is switched on at least for a time during the circulating sequence $U_1$. After the circulating sequence $U_1$ a pumping off sequence $A_1$ described in greater detail below is carried out the during which at least a significant part of the washing fluid S the to be found in the washing compartment 7 and now soiled his pumped off by means of the drain pump 31 to the waste water pipe AR for example.

For the cleaning cycle RG which is now subsequently carried out, further washing fluid is introduced into the washing compartment 7 by means of a further fill sequence $F_2$ and in is circulated in a further circulation sequence $U_2$. In this case the cleaning effect of the cleaning cycle is increased by the washing fluid S being heated up in a heating phase $H_2$ typically by means of the heater 24 and/or by means of the waste heat of a regeneration phase of the sorption drying device 39. For the same purpose there is an addition ZR of washing agents in the cleaning cycle RG, typically via the dispensing device 28. In this way the soiling adhering to the items to be washed can be almost complete the removed in the cleaning cycle RG. In order to pump away the heavily soiled washing fluid S of the cleaning cycle RG, a pumping-hound sequence $A_2$ is carried out at the end of said cycle.

The subsequent, single intermediate rinse cycle ZG includes a further fill sequence $F_3$ for filling the washing compartment 7 with washing fluid the S and also a further circulation sequence $U_3$, which basically serves for rinsing residues of the washing fluid S of the cleaning cycle RG from the items. At the end of the intermediate rinse cycle ZG a pump-off sequence $A_3$ is now carried out.

In the chronologically later final rinse cycle KG washing fluid S introduced it by means of a further fill sequence $F_3$ is now circulated in a circulation sequence $U_4$. In this case the addition ZK of rinse aid, for example via the dispensing device 29, is designed to reduce the surface tension of the washing fluid S. This means that the washing fluid S runs off the washed items better, which is a known way of avoiding spots on the items. The washing fluid of the final rinse cycle KG can be pumped away by means of a further pump-off sequence $A_4$.

In the concluding the drying cycle TG the items to be washed dried during a drying sequence $T_5$ in the exemplary embodiment by means of warm, dry air of the sorption drying device 39. It is also possible however to dry the items without a desorption drying device 39, especially through so-called self-drying, in which the drying is based at least partly on the fact that the washing fluid S adhering to the washed items evaporates because of the heat stored in the washed items. To bring the washed items up to the temperature required for this the washing fluid S used there could be heated up during the final rinse cycle KG by means of a heating phase not provided in the exemplary embodiment.

Subsequently especially the following adaptation measures are carried out on selection of the adapted or modified wash cycle SG' for "shine drying", by the control device entering a least one operating command at the operating device of the dishwasher.

Thus an adaptation measure consists, in selected part wash cycles, in the exemplary embodiment in the cleaning cycle RG in the intermediate rinse cycle ZG and in an additionally executed intermediate rinse cycle $ZG_z$, of modified pump-off sequences $A'_z$, $A'_3$ and $A'_z$ likewise described in further detail below being executed.

Thus at the end of the cleaning cycle RG a first, modified pump-off sequence $A'_2$ is executed, which is characterized by a residual amount of washing fluid S that is not able to be pumped off being reduced in relation to the original pump-off sequence $A_2$ in wash cycle SG (without shine drying). In this way transfer of soiling and/or washing agents into the first intermediate rinse cycle ZG carried out afterwards is reduced.

In this case in the first intermediate rinse cycle ZG the disruptive residues of foiling and washing agents can be removed especially well sense as a result of the almost complete pump-off of the washing fluid S of the cleaning cycle RG and especially clean washing fluid is available in the intermediate rinse cycle ZG. The washing fluid S of the first intermediate rinse cycle ZG additionally accepts only a little more soiling and/or washing agents during the first intermediate rinse cycle, so that the washing fluid S is significantly cleaner at the end of the intermediate rinse cycle ZG than would be the case if a non-modified pump-off sequence were to have been carried out at the end of the cleaning cycle RG.

At the end of the first intermediate rinse cycle ZG a further, i.e. here second modified pump-off sequence $A'_3$ is carried out, which is likewise characterized by a residual amount of washing fluid S not able to be pumped off being reduced in relation to the pump-off sequence $A_3$ during the wash cycle SG (without shine drying), which reduces the transfer of soiling and/or washing agent in the second intermediate rinse cycle $ZG_z$ additionally carried out.

At the end of the additionally carried out, i.e. here second intermediate rinse cycle $ZG_z$ a further, i.e. here third modified pump-off sequence $A'_z$ is carried out, which corresponds to the pump-off sequence $A'_3$ of the first intermediate rinse cycle ZG, i.e. is carried out in a similar way to said cycle. This further reduces a transfer of soiling and/or washing agents into the final rinse cycle KG following the second intermediate rinse cycle from the in any event already relatively clean washing fluid S of the additionally executed intermediate rinse cycle $ZG_z$.

On the other hand at the end of a pre-wash cycle PG the pump-off sequence $A_1$ is retained. This can speed up the execution of the wash cycle SG', whereby in any event an increased transfer of soiling into the subsequent cleaning cycle RG by washing fluid S not pumped off is possible. However this does not present any great problems since at the end of the pre-wash cycle VG a greater amount of soiling generally still adheres to the items to be washed, which in the normal case is loosened in the subsequent cleaning cycle RG and accumulates in the washing fluid S used there, so that a possible transfer of soiling by non-pumped off washing fluid from the pre-wash cycle VG into the cleaning cycle RG does not come into play.

The washing fluid of the final rinse cycle KG can easily be provided by a modified pump-off sequence $A_4$, since because of its lower soiling and/or washing agent content a significant transfer of soiling and/or washing agent is not possible in a later wash cycle SG or a later adapted wash cycle SG'.

It is important however for the last washing fluid S of the wash cycle SG', through the execution of the—here in the exemplary embodiment, preferably three altogether—modified pump-off sequences $A'_2$, $A'_3$ and $A_z$ for the cleaning cycle RG, for the first intermediate rinse cycle ZG and also the subsequent second intermediate rinse cycle $Z_z$, so the formation of spots on the cleaned items is further reduced after the end of the concluding drying cycle TG and a particular shine drying effect is achieved on the washed items, especially for glassware.

During the overall duration of the modified pump-off sequences $A'_2$, $A'_3$, and $A_z$ the circulating pump 22 is preferably switched off in each case. This prevents washing fluid S being distributed during the modified pump-off sequences $A'_2$, $A'_3$, and $A_z$ by the circulating pump 22 in the dishwasher 1, so that said fluid can be better pumped off by means of the drain pump 31.

A further adaptation measure consists, as already explained, of at least one additional intermediate rinse cycle $ZG_z$ being carried out during the adapted wash cycle SG'. The result of this is better rinsing of soiling and/or washing agents from the washed items, which counteracts the formation of spots on the cleaned items and thus leads to a higher shine on the cleaned items.

In this case in the exemplary embodiment a further adaptation measure has the effect in the additional intermediate rinse cycle $ZG_z$ of adding $ZK_z$ rinse aid to a washing fluid S used in said cycle. This reduces the surface tension of the washing fluid S so that, at the end of the additional intermediate rinse cycle $ZG_z$, a greater proportion of the washing fluid loaded with soiling and/or washing agent residues, runs off and/or drips off the items to be washed, so that a greater proportion and the soiling and/or washing agent residues contained therein can be pumped away which counteracts the formation of spots on the clean items and thus leads to a greater shine on the cleaned items. As an alternative or in addition there could also be provision for rinse aid to be added in a first intermediate rinse cycle ZG.

Furthermore a further adaptation measure in the intermediate rinse cycle ZG has the effect in the exemplary embodiment of lengthening a period of time $Z_3$ between a circulating sequence $U_3$ for circulating the washing fluid and a pump-off sequence $A'_3$ for pumping off the washing fluid and also in the additional intermediate rinse cycle $ZG_z$ of lengthening a period of time $Z_z$ between a circulating sequence $U_z$ for circulating the washing fluid and a pump-off sequence $A'_z$ for pumping off the washing fluid. This additional drip-off wait time enables in each case a greater part of the washing fluid S at hearing to the items to be washed to drip off and/or drain off, so that a greater part of the washing fluid S and the soiling and/or washing agent residues contained therein can be pumped away, which counteracts the formation of spots on the clean items and thus leads to a greater shine on the cleaned items.

A further adaptation measure causes at least one additional heating phase $H_4$ to be carried out during the final rinse cycle KG before the addition ZK of rinse aid to a washing fluid S used in said cycle. Some rinse aids tend to foam the heavily in a relatively cold washing liquor with a temperature of for example less than 35° C. It is precisely when several—here in the exemplary embodiment two—unheated intermediate rinse cycles ZG, $ZG_z$ are carried out that the critical temperature of the washing fluid S in the final rinse cycle KG can be significantly undershot. By providing an additional heating phase $H_4$ before the addition ZK of the rinse aid, which is especially advantageous in the drying of the washed items in the exemplary embodiment by an especially dry, warm flow of air, a disproportionate formation of foam can be securely prevented. This enables the washing fluid of the final rinse cycle KG evenly to wet the items to be washed, which counteracts the formation of spots on the cleaned items and leads to a greater shine on the cleaned items.

In another advantageous exemplary embodiment which for example makes provision for self-drying, for drying the items to be washed, there could also be provision for lengthening a heating phase already provided in any event, whereby the lengthening could amount to at least 10%, preferably at least 20%, especially preferably at least 30% of the original duration of the heating phase.

A further, especially optional, additional adaptation measure brings about a lengthening of a duration of the drying cycle TG, whereby the lengthening amounts to at least 10%, preferably at least 20%, especially preferably at least 30%, of the original or regular duration of the drying cycle TG (for a wash cycle without shine drying). By lengthening a duration of the drying cycle TG an improvement in the drying effect is achieved, whereby hollow vessels such as drinking glasses can also be better dried in this way and the shine effect is more readily evident. With the said minimum values for the lengthening a significant improvement in the drying effect already occurs.

Overall the adaptation measures prevented bring about an improvement in the resulting shine during wash cycle SG'. The adaptation measures can in this case in principle be provided individually or in any combination.

Figure 4:
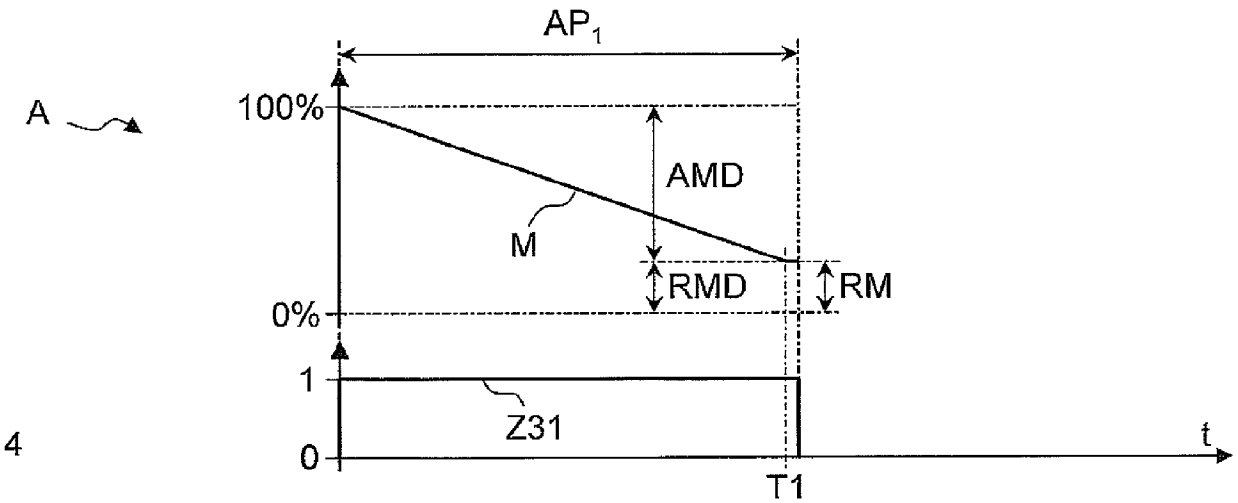

FIG. 4 shows a schematic presentation of a pump-off sequence A of the inventive dishwasher of FIGS. 1 and 2, which corresponds to the pump-off sequences $A_1$, $A_2$, $A_3$ and $A_4$ for the wash cycle SG (without shine drying) shown in FIG. 3. In this case the upper part of the diagram shows the amount M of washing fluid S still remaining in the washing compartment 7 in relation to the amount A present at the beginning of the pump-off sequence plotted over the course of time. This amount M can also be referred to as a relative amount M in terms of percentage %.

The operating state Z31 of the drain pump 31 is shown in a lower part of the diagram. In this case the operating state "1" means that the drain pump 31 is switched on and the operating state "0" that the drain pump 31 is switched off The pump-off sequence A includes a pump-off phase $AP_1$ during which the drain pump 31 is respectively permanently switched on, i.e. switched on continuously without interruption. The drain pump 31 can especially be embodied as an electrical centrifugal pump, typically as a radial pump, a half-radial pump or as an axial pump. The embodiment of the drain pump 31 as a centrifugal pump leads, in an improved manner or other than for example in an embodiment as a piston pump, to the function of the drain pump even being ensured when the washing fluid to be pumped off is heavily soiled.

If the drain pump 31 now embodied as a rotary pump is switched on at the beginning of the pump-off phase $AP_1$, the relative amount M of the washing fluid S present in the dishwasher 1 initially falls essentially linearly over the course of time with the speed of the drain pump 31 remaining constant. If the value falls below a specific residual amount RMD of washing fluid S at time T1, an amount of air gets into the circulating pump 31 however, such that the pressure for conveying washing fluid S collapses and consequently the washing fluid S is no longer conveyed. This state can be established by means of the monitoring device 38 typically by monitoring an electrical parameter of the drain pump 31, whereby the pump-off phase $AP_1$ can subsequently be ended.

In this way, at the end of the pump-off phase $AP_1$, a residual amount RMD of washing fluid S not able to be pumped off in continuous operation of the drain pump 31 remains in the dishwasher. On the other hand this ensures that during the first pump-off phase $AP_1$ the amount AMD of washing fluid S able to be pumped off in continuous operation of the circulating pump 31 will actually be pumped out.

Optionally there can be provision for the end of the first pump-off phase $AP_1$ to occur, if no undershooting of the minimum value for the flow of washing fluid is established by means of the monitoring device 38 after a predetermined period of time has elapsed. In this way it is possible to prevent the first pump-off phase $AP_1$ being continued endlessly in the event of a malfunction of the monitoring device 38.

Figure 5:
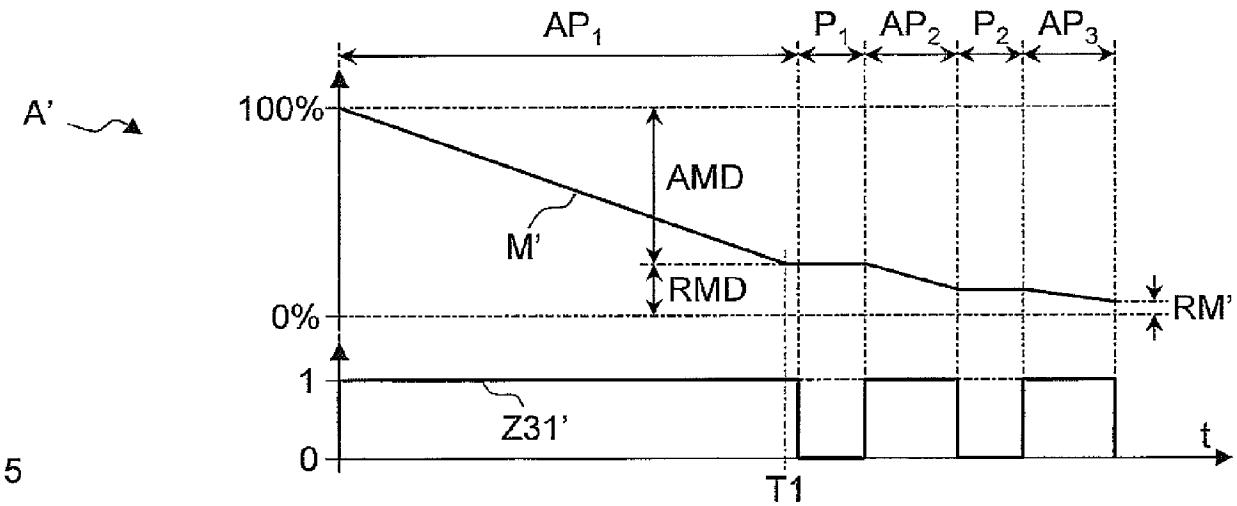

FIG. 5 shows, especially for a wash program "shine drying" selected by the user, a schematic diagram of a modified pump-off sequence A' of the inventive dishwasher of FIGS. 1 and 2, which corresponds to the pump-off sequences $A'_2$, $A'_3$ and $A'_z$ shown in FIG. 3. The modified pump-off sequence A', in addition to the pump-off phase $AP_1$, of the original pump-off sequence A, includes two additional consecutive pump-off phases $AP_2$ and $AP_3$, during each of which the drain pump 31 is permanently switched on. Furthermore pauses $P_1$, and $P_2$ are provided, during which the circulating pump 31 is permanently switched off The first pump-off phase $AP_1$ is separated by a pause or dead time $P_1$ from its neighboring subordinate phase in time, i.e. the second pump-off phase $AP_2$ here and this in its turn is again separated by a pause $P_2$ from its neighboring, i.e. here subsequent third pump-off phase $AP_3$.

During the second pump-off phase $AP_2$, when the drain pump 31 is switched on, the relative amount M continues to reduce. The effect which leads to the relative amount M of washing fluid S being reduced is not conclusively clarified. However it has been shown that after the first pump-off phase AP1 when the circulating pump 31 starts after the pause $P_1$, the pressure for conveying the washing fluid S is built up at least for a short time, although the value is below that of the residual amount RMD of washing fluid S not able to be pumped off by means of continuous operation of the drain pump 31.

This effect surprisingly also occurs after the second pause $P_2$ during the third pump-off phase $AP_3$, so that the relative amount M continues to fall. This enables a residual amount RM' of washing fluid S not able to be pumped off with the modified pump-off sequence A', which remains in the dishwasher 1 at the end of the modified pump-off sequence A', to be greatly reduced compared to the residual amount RM not able to be pumped off of the pump-off sequence A. By carrying out a least three pumping-off phases $AP_1$, $AP_2$ and $AP_3$ per modified pump-off sequence the described effect can thus be used a number of times, so that the residual amount RM' of washing fluid S not pumped off at the end of the modified pump-off sequence A' can be reduced especially greatly. For further reduction of the residual amount RM' of washing fluid not able to be pumped off with the modified pump-off sequence A', further pump-off phases not shown in the diagram, separated by pauses, could be provided.

In particular in such cases the pauses $P_1$ and $P_2$ can have a duration of at least 1 second, preferably of a least 2 seconds, especially preferably of a least 4 seconds and/or of at most 24 seconds, preferably of at most 12 seconds, especially preferably of at most 6 seconds. The specified minimum values for the duration of the pauses $P_1$ and $P_2$ are sufficient under normal circumstances for the washing fluid S agitated in the respective preceding pump-off phase $AP_1$ or $AP_2$ to assume an idle state in the drain pump 31 during the respective pause $P_1$ or $P_2$, in which at least a brief pressure buildup is possible by starting up the drain pump 31. It is further ensured by the specified highest values that the entire pump-off sequence A lasts no longer than necessary.

Preferably the pump-off phases $AP_2$ and $AP_3$ following the first pump-off phase $AP_1$ have a duration of at least 1 second, preferably of at least 2 seconds, especially preferably of at least 4 seconds, and/or of at most 32 seconds, preferably of at most 16 seconds, especially preferably of at most 8 seconds. With the specified minimum values for the duration of the pump-off phases $AP_2$ and $AP_3$AP following the first pump-off phase $AP_1$, the maximum amount of washing fluid S able to be pumped off additionally when the drain pump 31 starts up can be achieved in each of the subsequent pump-off phases $AP_2$ and $AP_3$. It is further ensured by the specified highest values that the entire modified pump-off sequence A' lasts no longer than necessary.

By reducing the residual amount RM' of washing fluid not able to be pumped off by means of the modified pump-off sequence A' compared to the unmodified, regular pumping-off sequence A, in particular a transfer of soiling and/or washing agents from the washing fluid used before the modified pump-off sequence A' into a washing fluid S used after the modified pump-off sequence is reduced. This allows the soiling content and/or washing agent content in the last bath quantity of washing fluid S, which will be used last in the adapted wash cycle SG', which is here the wash bath quantity for the final rinse cycle KG, to be reduced, which reduces the formation of spots on the cleaned items after the end of the drying cycle. The cleaned and dried washed items are then given a particular shine, especially if they are glassware.

In general terms the following mode of operation of the drain pump in the event of an emptying of the washing compartment that is as complete as possible, especially of its pump sump or liquid collection area, especially in conjunction with the "shine drying" program, but also initiated by it, is advantageous: Viewed over the overall duration of the respective pump-off sequence which is carried out at the end of a part wash cycle, for which an emptying of the washing compartment that is as complete as possible, especially of its pump sump or liquid collection area is demanded, at least three consecutive pump-off phases of the drain pump are carried out with intermediate pauses, i.e. interruption periods of the drain pump operation. This is thus operated especially "stutteringly", i.e. preferably in at least three alternations of pump running and pause or interruption of the drain pump operation. The at least two renewed pump startups offset from one another by pauses after the first pump-off phase allow at least two more surges of fluid to be pushed out of the pump sump of the washing compartment into the outflow device, although the drain pump, in the first pump-off phase, has already pumped off the fluid level in the pump sump or in the liquid collection area of the washing compartment to below the liquid amount threshold value, from which point it especially begins to suck in air or from which point the residual amount of liquid remaining in the pump sump would no longer be able to be pumped off by an ongoing continuous operation of the drain pump. This threshold value can if necessary also be provided by a residual amount of liquid remaining in the liquid collection area or the pump sump of the washing compartment after a first pump-off phase during which the drain pump operates for a fixed predetermined period of time. Only by the first pump-off phase being interrupted and the speed of the drain pump being reduced for a predetermined pause duration or dead time duration compared to the speed in the first pump-off phase or by the pump being switched off completely, and thus by at least one second pump-off phase being executed offset in time from the first pump-off phase by increasing the speed again or by switching the drain pump on again, can a part of the residual amount of fluid remaining after the first pump-off phase in the liquid collection area or in the pump sump of the washing compartment be pumped into the outflow device. If after the end of the second pump-off phase, there is a wait for a further second pause period during which the speed of the drain pump is reduced in relation to the pumping-off speed or the drain pump is switched off, and then once again in a third pump-off phase the drain pump is activated, i.e. its speed is increased to a pre-determined pump-off speed or the drain pump is switched on, the drain pump can convey a further surge of liquid, i.e. a part amount of the residual amount of water remaining after the second pump-off phase in the collection area or pump sump of the washing container into the outflow device.

In this way the causes of spot formation on the washed items, such as transfer of washing agents and soiling in the final rinse cycle and/or of hardeners (e.g. minerals, salts) in the water can be reduced or avoided.

Instead of the drain pump being repeatedly switched on and off, at least especially three times, as an alternative a change in speed of the drain pump can be provided to the extent that its speed is increased during the respective pump-off phase and by contrast is reduced during the respective subsequent pause. The changing speeds are in this case expediently selected so that the behavior of the drain pump at low speed essentially corresponds to its off state and at high speed on the other hand essentially corresponds to its on state. This is assigned a predetermined pump-off speed.

In particular it can be especially advantageous for the drain pump per modified pump-off sequence to pump off at least 3 further times with an intervening pause in each case after the first pump-off phase. In the respective pump-off sequence A'(see FIG. 5) its third pump-off phase AP3 after a wait of a pause or pump-off interruption respectively, is followed by a fourth pump-off phase AP4, during which the drain pump runs for pumping off once more. This fourth pump-off phase AP4 has been omitted from FIG. 5 to make the diagram clearer. At least three pump-off phases AP2-AP4 following the first pump-off phase AP1 ensure an especially good emptying of the liquid collection area or pump sump of the washing container.

In particular it can be expedient for one or more of the previously illustrated modifications of the wash cycle sequence to be carried out for the specific program "shine drying" for a dishwasher which has a sorption drying system, preferably a so-called Zeolite system. This is characterized especially by a very energy-efficient and above all very effective drying process. This sorption drying system can if necessary be used in combination with a conventional condensation drying system, in which the amount of liquid is heated up by means of a heating device, especially a liquid heating device such as a continuous flow heater for example and/or an air heating device in the final rinse cycle to correspondingly high temperatures and the items to be washed are sprayed with it and thus heated up. The items heated up in this manner, especially just solely by means of the sorption drying device, then dry because of its inherent heat and through condensation of the humidity in the washing container on the washing container walls that are cooler compared to the heated items.

Optionally the program "shine drying" can of course also be implemented in a dishwasher which is only equipped with a conventional drying device, especially a condensation drying device. Even then adequate shine drying of the washed items is achievable.

The modifications illustrated above have the effect as individual measures or in combination, especially preferably as a totality, of making the cleaned items, such as dishes, especially glasses, cutlery pots spot-free after they have been dried.

The shine drying effect on the washed items can especially be supported or brought about by the following measures:

the use of rinse aids: This is because it may be expedient for the control device only to make the "shine drying" program possible the corresponding dispensing device in the dishwasher has been filled to a sufficient level with the rinse aid. Otherwise the control device expediently locks or deactivates the operating device for selection of the "shine drying" program. If an extra button "shine-drying" is actually provided for selecting or activating/deactivating the "shine drying" program, this function button can be locked or blocked by the control device in the absence of an amount of rinse aid sufficient for the wash cycle. As an alternative or in addition, this lack of rinse aid for the request for refilling with rinse aid can be signaled to the user by means of the information output, especially display device of the dishwasher.

Additional dilution steps for flushing out washing agent residues/soiling residues, such as a second intermediate rinse, a shower, an intermediate flush, and/or more water in final rinsing etc . . . The respective intermediate flush of fresh water in this case can be carried out especially after the end of the respective circulating phase of the circulating pump before and/or after the end of the respective pump-off sequence or especially of its respective pump-off phase in one or more of the part wash cycles preceding the drying cycle, especially the final rinse cycle. In this case, with each intermediate flush, clean fresh water is additionally let in via the water inlet device controllable by the control device into the washing compartment for the respective liquid-conveying part wash cycle. This leads to a dilution of any washing agent residues and/or soiling particles which may be present in the washing fluid. If necessary it can be expedient in addition to or independently of this for a shower process to shower the items to be washed by means of fresh water which is let in via the water inlet device, especially as an intermediate surge, to be carried out before the respective pump-off sequence, preferably the respective pump-off phase. To this end the circulating pump is switched on a spray is applied by means of the one or more spray devices to the items to be cleaned. By means of the bath quantities diluted in this way washing agent residues and/or soiling particles can be washed off from the items to bee washed as well as from components, such as the spray devices, crockery baskets, holders, etc. in the washing compartment and/or from the inner walls of the washing compartment and can be drained away by means of the drain pump in the next pump-off phase from the washing compartment into the outflow device. In this way an undesired transfer of washing agent residues and/or soiling particles from the cleaning cycle into the final rinse cycle can be reduced far enough and/or in the last liquid-conveying wash cycle, i.e. in the final rinse cycle, a thinning out of the wash bath amount by addition of fresh water can be carried out such that the concentrations of the washing agent residues and/or soiling particles in the wash bath amount during the final rinse cycle become so small that washing agent residues and/or contamination particles are not visible to the human eye, negligible or cannot be deposited at all in the subsequent drying cycle after evaporation of the adhering drops of water as spots on the washed items. Thus the completely dried items exhibit hardly any spots or no spots at all. They can also be dried better. This is because the action of the rinse aid can be improved during the final rinse cycle since adverse affects of the action of its content material by the reduction or the absence of contamination particles and/or washing agent residues are largely avoided.

- A specific pump-off mode with a "stutteringly operated drain pump", with the object of reducing the transfer of washing agent residues and/or soiling particles into the final rinse cycle. This "stuttering operation" of the drain pump is explained in detail above with reference to FIG. 5 for example.
- An additional wait time (such as e.g. $Z_3$, $Z_z$ in FIG. 3) after the circulation process of the respective intermediate rinse cycle, especially after the respective intermediate rinse cycle, so that more washing fluid can drip off the items to be washed and the components in the washing compartment and can then be pumped off by means of the drain pump in the respective intermediate rinse cycle, especially modified pump-off process, from the washing compartment.
- Reduction of the amount of dead water in the hydraulic circulation system of the dishwasher. Thus for example the water switch and/or all valve devices for all feeds to the one or more spray devices can be put into a position in which amounts of residual water in the pump drain into the pump sump and can be pumped off from there by means of the drain pump. If a water switch is present its rotating disk or rotatable cylinder is expediently turned from one connecting position to the next connection position in which the respective outlet openings of the rotating disk or of the rotatable cylinder covers the inlet opening of the feed line(s) to the one or more spray devices, such that in each case dead water or residual water which is standing in the pipes, can run back as a result of its gravitational force into the pump sump or into a collection device and can be pumped away from there by means of the drain pump.
- Lengthening the drying time duration (slowing down drying). E.g. the speed of the fan in the air-guiding duct of the sorption drying system can be reduced compared to the speed of the fan during execution of the drying cycle of non-shine drying programs.

With the aid of these modified operating steps and/or redesigns, which are used individually or in combination in the wash cycle of the selected "shine drying" dishwasher program, a spot reduction and/or an improvement in drying can be ensured for a dishwasher, especially for a dishwasher with a Zeolite system. This is because the causes of spot formation, such as for example the transfer of washing agents and soiling into the final rinse cycle and/or of hardeners (e.g. minerals, salts) in the water can be reduced or avoided by these steps.

Summarized as bullet points and also in a simplified manner, the following modifications can be carried out especially expediently in the washing sequence during the selected "shine drying" dishwashing program individually or in any given combination for spot reduction by comparison with the other wash programs, i.e. "non-shine drying programs":

- The pump-off processes are optimized by the "stuttering operation" of the drain pump (as explained in the exemplary embodiment for FIG. 5 for example). This allows residual amounts of water remaining in the pump sump or liquid collection area of the washing compartment to be reduced and the transfer of washing agent residues and/or soiling particles from the cleaning cycle into the final rinse cycle to be reduced or largely avoided.
- At least one second intermediate rinse is carried out which makes better washing of washing agents and/or soiling residues and also thinning of the residual water remaining in the washing compartment after the end of the second intermediate rinse cycle.
- Rinsing aids are additionally used in the second, in general terms the last intermediate rinse. This enables the washing fluid to run off the items to be washed and/or the components in the washing compartment during the last intermediate rinse in an improved manner.
- The wash bath amount in the final rinse cycle of the shine drying wash program can be increased in relation to the wash bath amount in the other wash programs, which further dilutes the final rinse wash liquor fluid.

Furthermore in an advantageous manner if necessary, also in addition, one or more of the following modifications for controlling the cleaning power can be carried out individually or in any given combination in the selected "shine drying" dishwashing program, i.e. in particular the following parameters for increasing the drying power can be changed compared to the non-shine drying programs:

- Lengthening of the drying time (especially fan running time in a sorption drying system) for example by >10 min
- Short heating phase/heating up the washing liquor fluid to minimum temperature before the addition of rinse agent in final rinsing, in order to avoid foaming of the water laden with rinse aid.

The measures listed above and/or below can be integrated (possibly also only in part) depending on the basic program structure:

- Improved pumping off ("stutter pump"): Here pumping off with "empty state detection" (detection via the BLDC drain pump for example) is supplemented by further, especially at least two, preferably at least three pump-off steps (short pause in each case followed by short pump-off phase). Preferably in each pump-off sequence of the drain pump in its "stutter mode" at least three pumping-off phases are carried out, each with a wait time or pause between each two consecutive pump-off phases). This enables more water to be removed from the pump sump, which reduces the transfer of washing agent residues and/or soiling particles and/or hardeners and also reduces other contamination.

Additional intermediate rinsing, i.e. at least two consecutive intermediate rinses, are provided: This process dilutes and rinses off washing liquor still present in the appliance (e.g. on the dishes and/or on components in the washing compartment and/or in the pump sump), which reduces a transfer of washing agent residues and/or soiling particles and/or hardeners and also reduces other contaminants and dilutes the washing liquor fluid more than with only a single intermediate rinse (which is provided in the other wash programs without shine drying, non-shine drying programs).

Rinse aids in intermediate rinse cycles: The additional provision of a small amount of rinse aid during the last intermediate rinse cycle reduces the surface tension of the water. This results in the water draining off the dishes better. The transfer of washing agent residues and/or soiling particles and/or hardeners and also other contaminants is further reduced.

Increasing the bath amount in the final rinse cycle in the shine drying program compared to the respective final rinse cycle in the other wash programs without shine drying, non-shine drying wash programs. This ensures that the wash bath amount is more diluted.

Heating in the final rinse: A further intermediate rinse, especially the second intermediate rinse, cools the dishwasher down further and the bath temperature of the final rinsing liquor is lower than in the respective final rinse cycle in the other wash programs without shine drying. At lower wash bath temperatures some rinse agents tend to foam. Therefore here in the shine drying program the wash bath liquid is heated up where necessary to a minimum temperature, above which undesired foaming is avoided.

Lengthened drying phase: By lengthening the time for which the fan of the sorption drying system runs, drying of the washed items, especially of dishes for example, is improved.

In particular, in addition to or independently of this, the manner of the pumping off of wash bath liquid after the respective liquid conveying part wash cycle which precedes the rinse cycle of the "shine drying program" can be changed in an advantageous manner into "stuttering pumping out"; this is especially explained in relation to the exemplary embodiment of FIG. 5:

With conventional pumping off (pumping off until the empty state is detected) typically around 160-180 ml of washing liquor remains in the pump sump.

The modified pumping off enables these residual amounts of washing liquor fluid to be reduced to around 60-100 ml for example.

With modified pumping off even more pumping steps (at least 2 steps, preferably at least 3 steps) are appended to the series pumping out:

Typically the modified pumping off (schematic) can be especially executed as follows:

Pumping off until the empty state is detected
Pause (5 sec)
Pump off (7 sec)
Pause (5 sec)
Pump off (7 sec)
Pause (5 sec)
Pump off (7 sec)

For example a program sequence (schematic) without "shine drying" can especially appear as follows:

Cleaning (e.g. with 3.9 l of water)
Pumping off
Intermediate rinse (e.g. with 2.9 l of water)
Pumping off
Final rinse (e.g. with 2.5 l of water)
Drying phase By contrast, the program sequence (schematic) with "shine drying" (improved drying and less spot formation) can be carried out as follows:

Cleaning (e.g. with 3.9 l of water)
Modified pumping off
First intermediate rinse (e.g. with 2.9 l of water)
Modified pumping off
Additional, i.e. second intermediate rinse (e.g. with 3 l of water and addition of rinse aid)
Modified pumping off
Final rinse (e.g. with 3.0 l of water, i.e. increased amount and additional heating to around 35-38° C. before the rinse aid is added)
Lengthened drying phase In order to achieve a good drying result with few spots, there is provision for the separate use of rinse aid (i.e. the dispensing of rinse aid via the dispensing system of the dishwasher,) and this is recommended.

Despite this, should a customer not add any rinse aid or should the amount of rinse aid in the dispensing system of the dishwasher not be sufficient and instead of this just use a multifunction tab, such as a so-called "3in1" or "5in1" tab for example, the following remedial measures can be taken where necessary, which modify the shine drying program, in order to especially ensure that by the selection of "shine drying" the drying result which is normally achieved without the additional function "shine drying" is not noticeably worsened: To this end the additional intermediate rinse for the first intermediate rinse is retained. However the bath amounts in this additional intermediate rinse and in the subsequent final rinse are each reduced to e.g. 2.5 l by comparison with the rinse bath amounts for the second intermediate rinse and final rinse of the shine drying program, in order to achieve a transfer of surfactants from the multifunction tab into the final rinse. In such cases the pumping off is again undertaken in the "conventional" mode. The additional dispensing of rinse aid in the last, especially second, intermediate rinse can be dispensed with if necessary. If necessary there can especially be heating to higher temperatures in the final rinse in order to bring a higher proportion of rinse aid from the tab into the final rinse and to improve drying. The lengthened drying time in particular can be retained.

What is claimed is:

1. A dishwasher, comprising:

a dispensing device configured to dispense rinse aid;

a control device, in which at least one wash program for carrying out a wash cycle having a number of part wash cycles for cleaning and/or drying items to be washed is stored, wherein the control device is programmed such that at least one part wash cycle can be modified by a user by way of one or more adaptation measures to improve avoidance of spots on the items to be washed and/or a drying result on the washed items when the wash cycle is modified and is carried out using the one or more adaptation measures; and an operating device for entering operating commands for the control device, wherein at least one operating command for carrying out one or more adaptation measures is adapted for input at the operating device and at least one second operating command for carrying out the wash cycle, with or without the one or more adaptation measures, is adapted for input at the operating device, wherein the control device is configured to execute a first set of the one or more adaptation measures to improve avoidance of spots only when the dispensing device is activated and a fill level of the rinse aid in the dispensing device is at or above a minimum level, and the control device is configured to execute a second set of the one or more adaptation measures to improve avoidance of spots when the dispensing device is deactivated or when the fill level of the rinse aid in the dispensing device is below the minimum level.

2. The dishwasher of claim 1, constructed in the form of a household dishwasher.

3. The dishwasher of claim 1, wherein the operating device includes an operating element dedicated to receive the operating command for carrying out adaptation measures.

4. The dishwasher of claim 1, wherein another one of the adaptation measures during the wash cycle causes at least one additional part wash cycle that is an intermediate rinse cycle to be carried out.

5. The dishwasher of claim 1, wherein one of the adaptation measures causes an increase in an amount of washing fluid used in a part wash cycle that is a final rinse cycle, with the increase resulting in at least 120% of an original amount of the washing fluid being used simultaneously in the part wash cycle.

6. The dishwasher of claim 5, wherein the increase is at least 30% of an original amount of the washing fluid.

7. The dishwasher of claim 5, wherein the increase is at least 40% of an original amount of the washing fluid.

8. The dishwasher of claim 1, wherein one of the adaptation measures, in the intermediate rinse cycle, causes an addition of rinse aid to a washing fluid used there.

9. The dishwasher of claim 1, wherein one of the adaptation measures causes a lengthening of a heating phase, with the lengthening amounting to at least 10% of the original duration of the heating phase, and/or an execution of at least one additional heating phase during a part wash cycle that is a final rinse cycle before the addition of rinse aid to a washing fluid used there.

10. The dishwasher of claim 9, wherein the lengthening is at least 20% of the original duration of the heating phase.

11. The dishwasher of claim 9, wherein the lengthening is at least 30% of the original duration of the heating phase.

12. The dishwasher of claim 1, wherein one of the adaptation measures causes a lengthening of a duration of a part wash cycle provided as a drying cycle, with the lengthening amounting to at least 10% of the original duration of the drying cycle.

13. The dishwasher of claim 1, wherein another one of the adaptation measures causes a lengthening of a duration of a part wash cycle provided as a drying cycle, with the lengthening amounting to at least 20% of the original duration of the drying cycle.

14. The dishwasher of claim 1, wherein another one of the adaptation measures causes a lengthening of a duration of a part wash cycle provided as a drying cycle, with the lengthening amounting to at least 30% of the original duration of the drying cycle.

15. The dishwasher of claim 1, further comprising:

a drain pump, wherein one of the adaptation measures causes a modification of at least one pump-off sequence for pumping off a washing fluid of a part wash cycle by the drain pump from the dishwasher, with the modified pump-off sequence reducing a non-pumped-off residual amount of washing fluid.

16. The dishwasher of claim 15, wherein the pump-off sequence comprises at lest one pumping off phase during which the drain pump is switched on or increases its speed, said modified pump-off sequence having at least on additional pump-off phase, during which the drain pump is switched on or speeds up, wherein the additional pump-off phase is separated by a pause, during which the drain pump is switched off or reduces speed, from the respective preceding pump-off phase.

17. The dishwasher of claim 15, wherein the modified pump-off sequence comprises a total of at least three pump-off phases.

18. The dishwasher of claim 15, wherein in at least one of the pump-off sequence and the modified pump-off sequence a first pump-off phase of the pump-off phases is provided for pumping off an amount of washing fluid able to be pumped off in continuous operation of the drain pump.

19. The dishwasher of claim 15, further comprising a monitoring device for monitoring a flow of washing fluid conveyed by the drain pump, wherein in at least one of the pump-off sequence and the modified pump-off sequence a first pump-off phase of the pump-off phases is aborted when the monitoring device detects that a minimum value for the flow of washing fluid is being undershot.

20. The dishwasher of claim 1, further comprising a washing compartment, wherein the dishwasher is configured to circulate the washing fluid through the washing compartment.

21. The dishwasher of claim 1, wherein one of the adaptation measures, in at least one part wash cycle provided as an intermediate rinse cycle causes a lengthening of a period of time between a circulating sequence for circulating a washing fluid and a pump-off sequence for pumping off the washing fluid.

22. A method for operating a dishwasher with a dispensing device configured to dispense rinse aid and a control device in which at least one wash program for carrying out a wash cycle comprising a number of part wash cycles for cleaning and/or drying items to be washed is stored, and with an operating device for entering operating commands for the control device, said method comprising entering an operating command at an operating device to carry out one or more adaptation measures on at least one of the wash programs to improve avoidance of spots on the items to be washed and/or the drying result on the washed items, when executing the wash cycle based on the adapted wash program;

executing a first set of the one or more adaptation measures to improve avoidance of spots only when the dispensing device is activated and when a fill level of the rinse aid in the dispensing device above a minimum level; and executing a second set of the one or more adaptation measures to improve avoidance of spots when the dispensing device is deactivated or when the fill level of the rinse aid in the dispensing device drops below the minimum level.

23. The method of claim 22 for operation of a household dishwasher.

24. The method of claim 22, wherein one of the adaptation measures during the wash cycle causes at least one additional part wash cycle provided as an intermediate rinse cycle to be carried out.

25. The method of claim 22, wherein one of the adaptation measures causes an increase in an amount of washing fluid used in a part wash cycle provided as a final rinse cycle, with the increase amounting to at least 20% of an original amount of the washing fluid.

26. The method of claim 22, wherein one of the adaptation measures causes an increase in an amount of washing fluid used in a part wash cycle provided as a final rinse cycle, with the increase amounting to at least 30% of an original amount of the washing fluid.

27. The method of claim 22, wherein one of the adaptation measures causes an increase in an amount of washing fluid used in a part wash cycle provided as a final rinse cycle, with the increase amounting to at least 40% of an original amount of the washing fluid.

28. The method of claim 22, wherein one of the adaptation measures, in at least one part wash cycle provided as an intermediate rinse cycle causes an addition of rinse aid to a washing fluid used there.

29. The method of claim 22, wherein one of the adaptation measures causes a lengthening of a heating phase, with the lengthening amounting to at least 10% of the original duration of the heating phase, and/or an execution of at least one additional heating phase during a part wash cycle provided as a final rinse cycle before the addition of rinse aid to a washing fluid used there.

30. The method of claim 22, wherein one of the adaptation measures causes a lengthening of a heating phase, with the lengthening amounting to at least 20% of the original duration of the heating phase, and/or an execution of at least one additional heating phase during a part wash cycle provided as a final rinse cycle before the addition of rinse aid to a washing fluid used there.

31. The method of claim 22, wherein one of the adaptation measures causes a lengthening of a heating phase, with the lengthening amounting to at least 30% of the original duration of the heating phase, and/or an execution of at least one additional heating phase during a part wash cycle provided as a final rinse cycle before the addition of rinse aid to a washing fluid used there.

32. The method of claim 22, wherein one of the adaptation measures causes a lengthening of a duration of a part wash cycle provided as a drying cycle, with the lengthening amounting to at least 10% of the original duration of the drying cycle.

33. The method of claim 32, wherein one of the adaptation measures causes a lengthening of a duration of a part wash cycle provided as a drying cycle, with the lengthening amounting to at least 20% of the original duration of the drying cycle.

34. The method of claim 33, wherein one of the adaptation measures causes a lengthening of a duration of a part wash cycle provided as a drying cycle, with the lengthening amounting to at least 30% of the original duration of the drying cycle.

35. The method of claim 22, wherein one of the adaptation measures causes a modification of at least one pump-off sequence for pumping off a washing fluid of a part wash cycle by a drain pump from the dishwasher, with the modified one pump-off sequence reducing a non-pumped-off residual amount of washing fluid.

36. The method of claim 35, wherein the pump-off sequence comprises at lest one pumping off phase during which the drain pump is switched on or increases its speed, said modified pump-off sequence having at least on additional pump-off phase, during which the drain pump is switched on or speeds up, wherein the additional pump-off phase is separated by a pause, during which the drain pump is switched off or reduces its speed, from the respective preceding pump-off phase.

37. The method of claim 35, wherein the modified pump-off sequence comprises a total of at least three pump-off phases.

38. The method of claim 35, wherein in at least one of the pump-off sequence and the modified pump-off sequence a first pump-off phase of the pump-off phases is provided for pumping off an amount of washing fluid able to be pumped off in continuous operation of the drain pump.

39. The method of claim 35, wherein in at least one of the pump-off sequence and the modified pump-off sequence a first pump-off phase of the pump-off phases is aborted when a monitoring device for monitoring a flow of washing fluid conveyed by the drain pump detects that a minimum value for the flow of washing fluid is being undershot.

40. The method of claim 22, wherein one of the adaptation measures, in at least one part wash cycle provided as an intermediate rinse cycle causes a lengthening of a period of time between a circulating sequence for circulating the washing fluid and a pump-off sequence for pumping off the washing fluid.

41. The method of claim 22, wherein at least one adaptation measure provided on entry of the operating command for carrying out adaptation measures is not executed when a dispensing device for adding rinse aids to the washing fluid is deactivated or when a fill level of rinse aid in the dispensing device drops below a minimum level.

* * * * *